US005505332A

United States Patent [19]

Vogelpohl et al.

[11] Patent Number: 5,505,332

[45] Date of Patent: Apr. 9, 1996

[54] VENDING MACHINE AND METHOD OF OPERATING SUCH

[75] Inventors: Gregory J. Vogelpohl; Phillip C. South, both of Orlando, Fla.

[73] Assignee: ECC International Corp., Orlando, Fla.

[21] Appl. No.: 311,488

[22] Filed: Sep. 23, 1994

Related U.S. Application Data

[63] Continuation-in-part of Ser. No. 265,711, Jun. 24, 1994.

[51] Int. Cl.[6] ..... G07F 11/10

[52] U.S. Cl. ..... 221/1; 221/193; 221/194; 221/150 R

[58] Field of Search ..... 221/1, 12, 193, 221/191, 194, 150 R, 250

[56] References Cited

U.S. PATENT DOCUMENTS

| | | | |
|---|---|---|---|
| 2,302,166 | 11/1942 | Anthony | 221/154 X |
| 3,001,669 | 9/1961 | Tandler et al. | 221/12 |
| 3,055,544 | 9/1962 | Krakauer et al. | 221/193 X |
| 4,977,754 | 12/1990 | Upton et al. | 221/150 R X |

FOREIGN PATENT DOCUMENTS

| | | | |
|---|---|---|---|
| 3118686 | 5/1991 | Japan | 221/193 X |
| 3154193 | 7/1991 | Japan | 221/193 X |

*Primary Examiner*—William E. Terrell
*Assistant Examiner*—Dean A. Reichard
*Attorney, Agent, or Firm*—James H. Beusse

[57] ABSTRACT

In a method of operating a vending machine, a glass container is dispensed with its vertical axis tilted in the vending machine in response to the selective generation of a preselected vending signal. The vertical axis is predeterminately altered into a generally vertically extending position in the vending machine, and the glass container is dropped base portion first in a generally vertical free fall path of the vending machine with the vertical axis of the glass container disposed in its vertical extending position. A vending machine is also disclosed.

32 Claims, 3 Drawing Sheets

VENDING MACHINE AND METHOD OF OPERATING SUCH

CROSS-REFERENCE TO RELATED APPLICATION

This commonly assigned application is a continuation-in-part of U.S. application Ser. No. 08/265,711 filed Jun. 24, 1994, still pending, which is incorporated by reference herein.

BACKGROUND OF THE INVENTION

In the past, various different schemes have been utilized to effect the selective vending of a vended article from a vending machine in response to a preselected vending signal. To effect the operation of one of the past vending machines, a purchaser actuated a vended article selection device, such as a selection button or set thereof for instance, of such vending machine thereby to indicate the vended article selected for purchase by the purchaser, and the purchaser also inserted the necessary amount of money into a money counting device of such vending machine for purchasing the selected vended article. In response of the aforementioned actuation of the vended article selection device and the receipt of the necessary purchase money in the counting device, circuitry provided in the vending machine was energized to establish the preselected vending signal, and upon the generation of the preselected vending signal, a vended article delivery or dispensing device was selectively operated to dispense the selected vended article into a receptacle or removal container of the vending machine permitting the retrieval therefrom of the selected vended article by the purchaser.

Of course, various different vended article dispensing devices were employed in various different vending machines to effect the delivery of the selected vended article to the purchaser, and one such article dispensing device is illustrated in U.S. Pat. No. 5,097,986 issued Mar. 24, 1992. In this patent, a rended article dispensing device is illustrated as a set of coils that are selectively conjointly rotatable in motor driven fashion about the longitudinal axis of the coils. A plurality of vended articles are disposed in horizontally supported compartments defined between adjacent coils, and upon the selected conjoint rotation of the coils, the vended articles contained in the coils are conjointly moved forwardly by a certain distance toward a front opening in a space supporting the vended articles. Thus, in response to the selected conjoint rotation of the coils, the forwardmost selected vended article in the coils is passed through the front opening in the space supporting the vended article and falls through a drop chute into a retrieval container from which it can be taken by a purchaser.

It is believed that the above discussed vended article dropped through the drop chute into the retrieval container may have been limited to unbreakable articles, such as articles in plastic wrappers or other items in plastic bags or the like for instance.

SUMMARY OF THE INVENTION

In general and in one form of the invention, a method is provided for operating a vending machine in response to the selective generation of a preselected vending signal to vend a selected beverage contained in a plurality of glass containers from the vending machine, and the glass containers each have a vertical axis and a base portion disposed about the vertical axis. In the practice of this method, one of the glass containers in the vending machine is dispensed in response to the selective generation of the preselected vending signal, and the vertical axis of the one glass container is tilted during the dispensing thereof in the vending machine. The vertical axis of the one glass container is predeterminately altered into a generally vertically extending position in the vending machine, and the one glass container is dropped base portion first through a part of the vending machine with the vertical axis of the class container disposed in its vertically extending position.

Further in general, a vending machine is provided in one form of the invention for dispensing a selected beverage in a glass container in response to the selective establishment of a preselected vending signal, and each glass container includes a generally vertical axis and a base portion disposed about the vertical axis. The vending machine has a cabinet, and a generally vertical passage means is arranged in the cabinet for receiving each glass container base portion first and with the vertical axis tilted when each glass container is dispensed in the vending machine upon the selective establishment of the preselected vending signal. The vertical passage means includes means engageable with another part of each glass container for realigning its vertical axis into a generally vertically extending position to ensure a generally vertical free fall passage of each glass container base first through the vertical passage means when each glass container is received therein. Another passage means is associated in generally angular relation with the vertical passage means in the cabinet for the passage of each glass container base portion first from the vertical passage means into the another passage means. Cushioning means associated with the another passage means is engageable with the base portion of each glass container for absorbing at least some of the energy of each glass container established during the vertical free fall passage of each glass container through the vertical passage means into the another passage means and for rebounding each glass container base portion first toward an arrested position in a part of the another passage means.

The exemplifications set out herein illustrate the preferred embodiment of the present invention in one form thereof, and such exemplifications are not to be construed as limiting either the scope of the disclosure or the scope of the invention in any manner.

DETAILED DESCRIPTION OF THE PREFERRED EMBODIMENT

Figure 1:
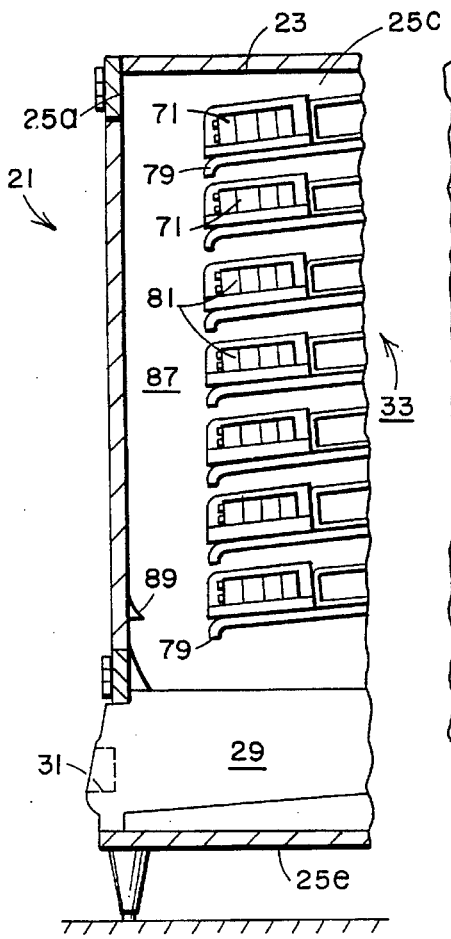
FIG. 1 is a partial sectional view of a vending machine in one form of the invention showing a plurality of trays for supporting vended beverages in glass containers disposed generally in vertically arranged tiers and in part defining a generally vertical drop chute for the glass containers in the vending machine.

Referring now to FIG. 1, there is shown in one form of the invention a vending machine 21 having a cabinet 23 formed by a plurality of enclosure panels 25 including a hinged, openable front panel or door **25*a* shown partially broken away which may be releasably locked in a closed position to provide controlled selective access to the interior of the cabinet. Front panel 25*a* frames a pane 27 of a generally transparent material, such as for instance a clear plastic or the like, which is also shown partially broken away, and the transparent pane provides a clear view into the interior of cabinet 23 when the front panel is closed. Generally adjacent the lower end of vending machine 21 is provided a glass container or bottle recovery unit 29 having at least one access opening 31 therein, and such unit is discussed in detail hereinafter. Vending machine 21** is contemplated to be refrigerated by a refrigeration system as is well known to the art; however, the components of such refrigeration system are omitted for the sake of brevity of disclosure and drawing simplification.

Figure 2:
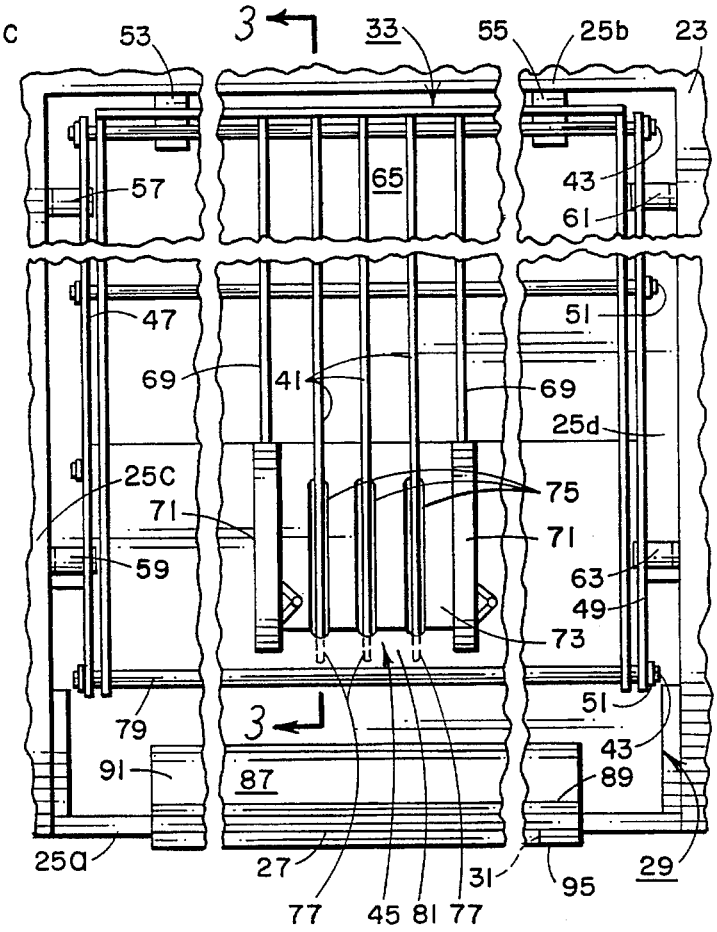
FIG. 2 is an enlarged plan view of one of the trays of FIG. 1 partially broken away to illustrate one of a plurality of channels arranged generally in side-by-side relation for slidably receiving glass containers in row formation and also to illustrate the mounting of such trays in the vending machine with respect to the vertical drop chute.
Figure 3:
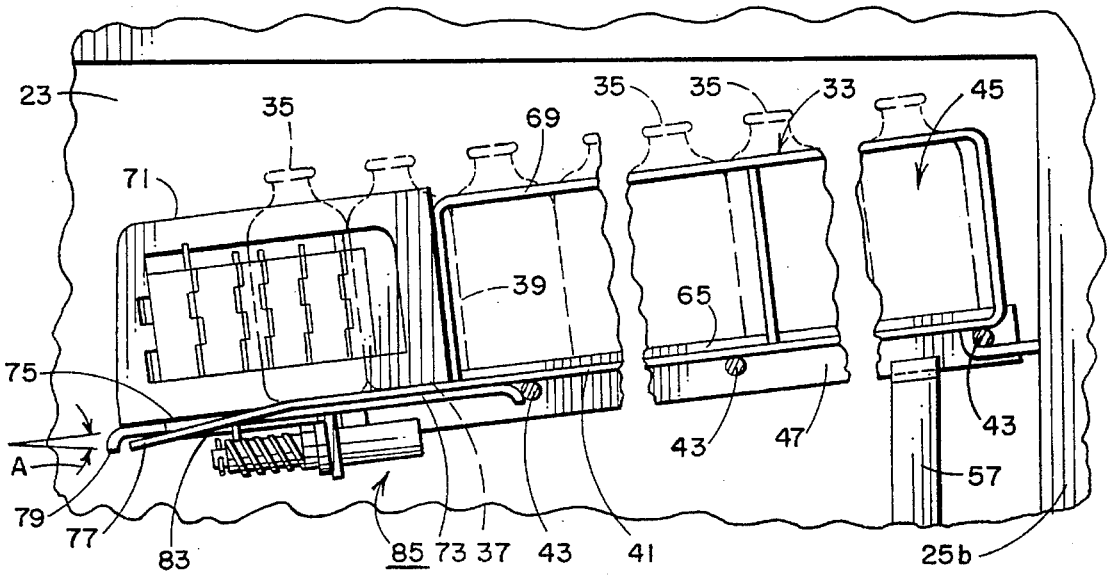
FIG. 3 is a sectional view taken along line 3—3 in FIG. 2.

A plurality of supporting means, such as shelves or trays 33 or the like for instance, are shown partially broken away in FIGS. 1–3, and as best seen in FIG. 1, the trays are arranged in generally vertically spaced apart tiers in cabinet 23 of vending machine 21. Trays 33 are provided in cabinet 23 for slidably receiving a plurality of glass containers or bottles 35 each containing a vended beverage, and each glass container has a vertical axis V with a base portion 37 and a circumferential portion 39 disposed generally symmetrically about vertical axis V. However, while glass containers 35 are illustrated in FIGS. 3 and 5–11, such glass containers are omitted from FIGS. 1 and 2 for the sake of drawing clarity.

As may be seen in FIG. 2 and 3, trays 33 are each formed of a plurality of spaced metallic wire sections 41 for slidably receiving or seating in guiding relation base portions 37 of glass containers 35, and wire sections 41 are interconnected in seated relation on a plurality of cross-rods 43. Wire sections 41 of each tray 33 form a plurality of columns or channels 45 arranged generally in side-by-side relation so as to be aligned generally in row formation between front panel **25*a* and a rear panel 25*b* opposite thereto in cabinet 23, and glass containers 35 are received in row formation in each channel with circumferential portions 39 of adjacent glass containers being engaged with each other, as best seen in FIG. 3. Each tray 33 is provided with a pair of opposite side mounting bars 47,49 through which cross-rods 43 extend, and a set of jam washers 51 are fixedly received on at least some of the cross-rods in displacement preventing engagement with the side mounting bars, respectively, as best seen in FIG. 2**.

A pair of sets of rear mounting brackets 53,55 are secured to rear panel **25*b* of cabinet 23 by suitable means, such as a plurality of screws (not shown) or the like for instance, and the rear mounting brackets releasably receive or seat in mounting engagement one of the cross-rods 43 of each tray, respectively. Pairs of opposed sets of side mounting brackets 57,59 and 61,63 are respectively secured to opposite side panels 25*c*, 25*d* of cabinet 23 by suitable means, such as a plurality of screws (not shown) or the like for instance, and the opposed side mounting brackets respectively releasably receive or seat in mounting engagement opposite mounting bars 47,49 of each tray 33. Thus, trays 33 are mounted or otherwise arranged in generally vertically spaced apart tiers within cabinet 23, as best seen in FIG. 1, and it may be noted that the trays are canted or sloped in a direction from rear panel 25*b* toward front panel 25*a* of the cabinet at a preselected angle A, generally about ten degrees (10°), as best seen in FIG. 3. It is contemplated that trays 33 may be mounted in cabinet 23 at various other angles different than those discussed above or may be mounted generally horizontally in the cabinet within the scope of the invention. The preselected angle or slope A of trays 33 mounted in cabinet 23 establishes a gravity feed of glass containers 35 in the row formation thereof in channels 45 of the trays toward front panel 25*a* of the cabinet and to maintain the circumferential portion 39** of adjacent glass containers of at least some of the glass containers engaged with each other in each channel of the trays.

As best seen in FIGS. 2 and 3, a set of adjacently spaced wire sections 41 of trays 33 define a base or base wall 65 in each channel 45 of the trays on which base portions of glass containers 35 are slidably received, and a pair of generally upstanding wire sections 41 define at least in part a pair of generally opposite sides or sidewalls 69 of channels 45 for sliding and guiding relation with the circumferential portion 39 of the class containers to maintain the row formations thereof in each channel. Wire sections 41 of bases 65 and opposite sides 69 of trays 33 and cross-rods 43 are coated with a suitable plastic material, as well known in the art, which enhances the slidability of glass containers 35 on the trays. Of course, adjacent channels 45 of trays 33 share opposite sides 69, and forming a part of some of the opposite sides is a release mechanism or control means 71 selectively operable in response to the selective generation of the aforementioned preselected vending signal for controlling the dispensing or slidable displacement of glass containers 35 from channels 45 of trays 33, as further discussed hereinafter.

Each tray 33 is provided with a lip or lip section 73 formed of a suitable sheet material, such as a sheet steel or the like for instance, and the lip forms a part of channel bases 65 extending across each tray into mounting or locating engagement with opposite mounting bars 47,49. Lip 73 has a plurality of sets of slots 75 arranged in each channel 45 of trays 33 to receive the forward or free end portions 77 of wire sections 41 defining channel bases 65. Free end portions 77 are predeterminately bent or otherwise formed to extend through slots 75 in blending relation with lip 73, and the blending relation of free end portions 77 and lip 73 provides not only a smooth transition but also added impulse for glass containers 35 sliding from channel bases 65 onto lip 73. A depending end or flange 79 integral with lip 73 extends across each channel 45 of trays 33, and each flange is respectively arranged in predetermined spaced apart relation with transparent pane 27 in front panel **25*a* of cabinet 23. Thus, lip 73 defines at least in part an open end or end portion 81 for each channel 45 of trays 33**.

A plurality of mounting brackets 83 each supporting a solenoid or solenoid means 85 are mounted to the underside of lip 73 adjacent each channel 45 on trays 33 by suitable means, such as for instance a plurality of screws (not shown) or the like, which extend through the lip into mounting engagement with release mechanisms 71 seated against the upper side of the lip so as to define a part of each channel 45 on trays 33. Each solenoid 85 is operable in response to the selective generation or establishment of the aforementioned preselected vending signal for effecting the actuation of release mechanisms 71 to selectively dispense or displace glass containers 35 from channels 45 of trays 33; however, for the sake of brevity of disclosure and drawing simplification only one of such solenoids, its mounting bracket and release mechanism is shown in FIG. 3. If a more detailed discussion of the construction and operation of release mechanisms 71 and solenoids 85 as well as their mounting association with lips 73 of each tray 33 is desired, reference may be had to the aforementioned U.S. patent application Ser. No. 08/265,711 filed Jun. 24, 1994 which is incorporated herein by reference. While the specific construction of trays 33, their component parts and mounting arrangement in cabinet 23 are set out hereinabove for the purpose of disclosure, it is contemplated that various other trays having different component parts and mounting arrangements may be utilized in vending machine 21 within the scope of the invention.

As previously mentioned and as may be seen in FIGS. 1 and 2, trays 33 are predeterminately arranged or mounted in vertically aligned tiers in cabinet 23 with lip flanges 79 on the trays each being predeterminately spaced generally horizontally from transparent pane 27 of front panel 25*a* in cabinet 23. Therefore, it may be noted that a generally vertical passage means, such as a drop chute 87 or the like for instance, is generally vertically provided in cabinet 23 extending through at least a major portion of the height of the cabinet to communicate with recovery unit 29 for glass containers 35, as discussed in greater detail hereinafter, and vertical chute 87 is defined in the cabinet generally between opposite side panels 25*c*, 25*d* thereof and between the front panel transparent pane 27 and the vertically aligned lip flanges 79 on trays 33. It may also be noted that open end portions 81 of channels 45 on trays 33 respectively communicate with vertical chute 87. To complete the description of vertical chute 87, a generally wedge-shaped abutment or abutment means 89 is secured by suitable means, such as an adhesive (not shown) or the like for instance, to front panel transparent pane 27 of cabinet 23 extending generally horizontally thereacross between opposite side panels 25*c*, 25*d*, and abutment 89 extends into vertical chute 87 generally adjacent the lower end thereof in spaced apart relation with respect to recovery unit 29, as best seen in FIGS. 1,2 and 4.

Figure 4:
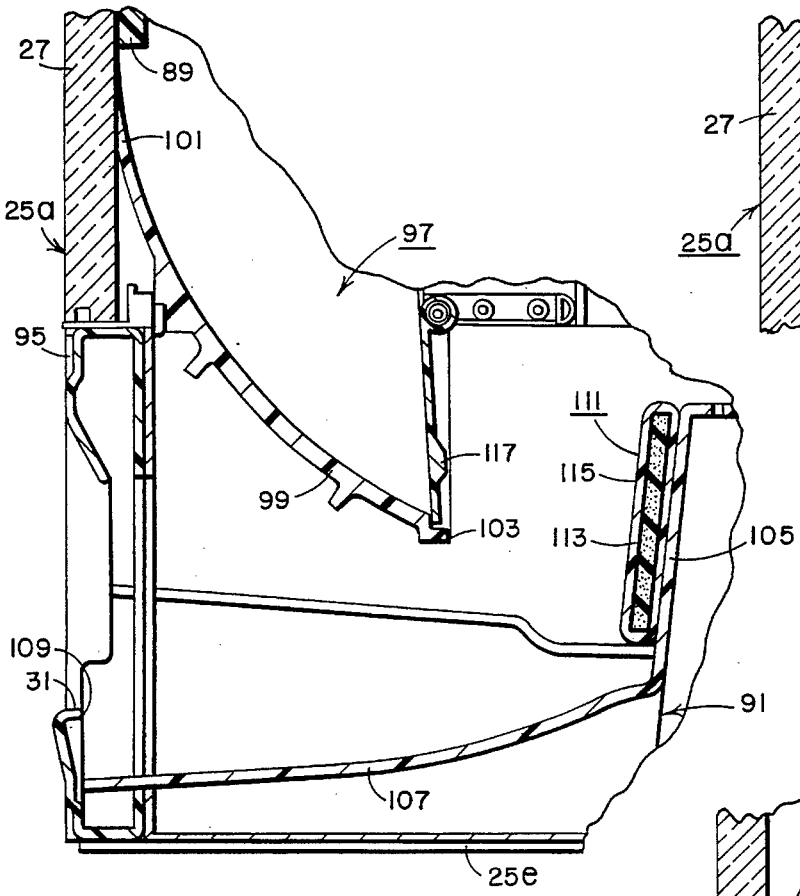
FIG. 4 is an enlarged fragmentary view showing a recovery unit in cross-section of the vending machine in FIG. 1 and illustrating the association of such recovery unit with the vertical drop chute of the vending machine.

Recovery unit 29 is provided with a casing 91 removably or slidably seated in a predetermined position in cabinet 23 of vending machine 21 on a lower or base panel 25*e* thereof, and the casing is disposed in part at least adjacent front panel 25*a* of the cabinet extending thereacross between opposite side panels 25*c*, 25*d* thereof FIGS. 2 and 4. While casing 91 is illustrated herein as being formed at least in part of a plastic material, it is contemplated that other materials well known to the art may be utilized in the formation of such casing within the scope of the invention. When door or front panel 27 of cabinet 23 is closed, the lower end of the front panel is engaged or otherwise seated against a cooperating confronting part of casing 91 thereby to releasably retain recovery unit 29 against displacement from its predetermined position in cabinet 23, as best seen in FIG. 4. A front face 95 of casing 91 is disposed exteriorly of cabinet 23 generally beneath front panel 25*a* thereof and access opening 31 is provided through the front face of the casing.

A reentrant passage or passage means 97 in casing 91 of recovery unit 29 is generally angularly arranged with respect to vertical chute 87 of vending machine 21, and the reentrant passage communicates with both vertical chute 87 and access opening 31 in front face 95 of the casing. A slide or slide means 99 defines a section of reentrant passage 97, and the slide has a pair of generally opposite ends or end portions 101, 103. Opposite end 101 of slide sections 99 is arranged to generally extend across and blend into abutment with transparent pane 27 in front panel 25*a* of cabinet 23 so as to be spaced adjacent abutment 89 on the transparent pane, and opposite end 103 defines a free end or end portion of the slide section arranged in predetermined spaced apart relation from a rear wall 105 of casing 91. A glass container receiver 107 defines another section of reentrant passage 97, and receiver section 107 extends from rear wall 105 of casing 91 toward front face 95 thereof. Thus it may be noted that slide section 99 and receiver section 107 not only communicate with each other adjacent rear wall 105 of casing 91 but also respectively communicate with vertical chute 87 in cabinet 23 of vending machine 21 and access opening 31 in front face 95 of casing 91. Means, such as a rim 109 or the like for instance, is integrally formed on front face 95 of casing 91 extending about at least a part of access opening 31 and into receiver section 107 of reentrant passage 97 for engagement with base portions 37 of glass containers 35 to generally define the arrested position thereof in the receiver section, as discussed in greater detail hereinafter. In view of the foregoing, it may further be noted that reentrant passage 97 defines another path for the glass containers 35 in vending machine 21 angularly arranged with and different than the aforementioned vertical free fall path of glass containers 35 in vending machine 21.

Casing 91 of recovery unit 29 has a cushioning device 111 interposed in reentrant passage 97 for engagement with base portions 37 of glass containers 35 to absorb at least some of the energy of the glass containers established during the vertical free fall passage thereof through vertical chute 87 into reentrant passage 97, as discussed in greater detail hereinafter. Cushioning device 111 comprises a yieldable means, such as for instance an elongate strip or pad of ergonomic urethane foam 113 or the like, encased in an envelope 115 of suitable material, such as a plastic or the like for instance, which is adhered or otherwise mounted to rear wall 105 of casing 91 in predetermined spaced relation from free end 103 on slide section 99 of casing 91. Ergonomic urethane foam strip 113 is available from E.A.R. Division of Cabot Safety Corp., Indianapolis, Ind. While cushioning device 111 is illustrated herein for the purpose of disclosure, it is contemplated that various other cushioning devices well known to the art may be utilized in recovery unit 29 within the scope of the invention.

Albeit not a part of this invention, the aforementioned refrigeration system (not shown) is provided in vending machine 21 for establishing a flow of refrigerated air within cabinet 23 to cool the vended beverages in glass containers 35 arranged on trays 33, and of course, vertical chute 87 and reentrant passage 97 are subjected to such refrigerated air in the cabinet. To complete the description of vending machine 21 and recovery unit 29, a closure or sealing device, such as a generally elongate door or seal 117 or the like for instance, is pivotally arranged or otherwise mounted to casing 91 in slide section 99 of reentrant passage 97 so as to be urged or otherwise pivotally disposed into a sealing or closed position for at least limiting egressing flow of the refrigerated air through the reentrant passage toward access opening 31 in front face 95 of casing 91.

In the operation of vending machine 21, a vended beverage selection device (not shown) of a type well known in the art, such as a set of selection push-buttons or the like for instance, may be selectively actuated by a purchaser to select from a particular channel 45 of a particular tray 33 a glass container 35 of the vended beverage which the purchaser desires to be vended from the vending machine. The purchaser will also insert the necessary amount of money into a money counting device (not shown) of a type well known in the art in vending machine 21 to effect the actuation of the money counting device. In response to the actuation of the aforementioned beverage selection device and money counting device, circuitry (not shown) of a type well known in the art is energized to establish or generate the preselected vending signal in vending machine 21. Since the aforementioned vended beverage selection device, money counting device and circuitry associated therewith form no part of this invention, a detailed discussion thereof is omitted for the sake of brevity of disclosure and drawing simplification.

Assume that the generation of the aforementioned preselected vending signal in vending machine 21 is effective to energize solenoid 85 which actuates release mechanism 71, as seen in FIG. 3, to dispense the leading one of the glass containers from channel 45 of tray 33 while retaining the other glass containers in the row formation thereof in channel 45. For the purpose of this invention, the mere disclosure that solenoid 85 and release mechanism 71 operate to dispense a glass container from channel 45 of tray 33 is believed to be sufficient; however, as previously stated, if a more detailed discussion of the construction and operation of the solenoid and the release mechanism, reference may be had to U.S. patent application Ser. No. 08/265,711 filed Jun. 24, 1994.

Figure 5:
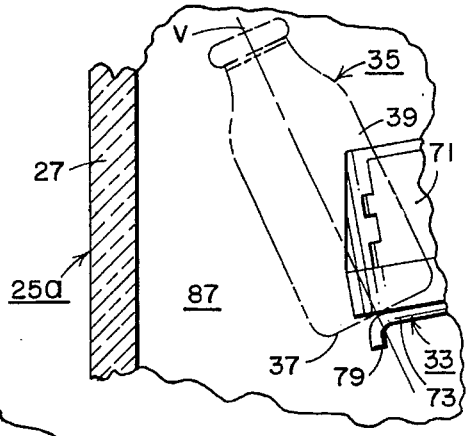
FIGS. 5–8, respectively, are enlarged fragmentary views taken from FIG. 1 showing the dispensing of a glass container in the vending machine from the tray channel through the vertical drop chute into the recovery unit and illustrating principles which may be practiced in a method of operating a vending machine also in one form of the invention.
Figure 6:
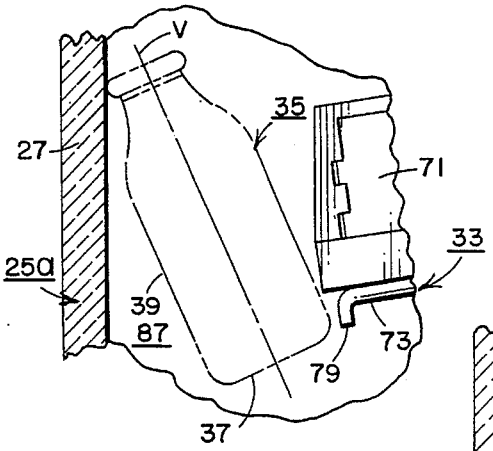
Figure 7:
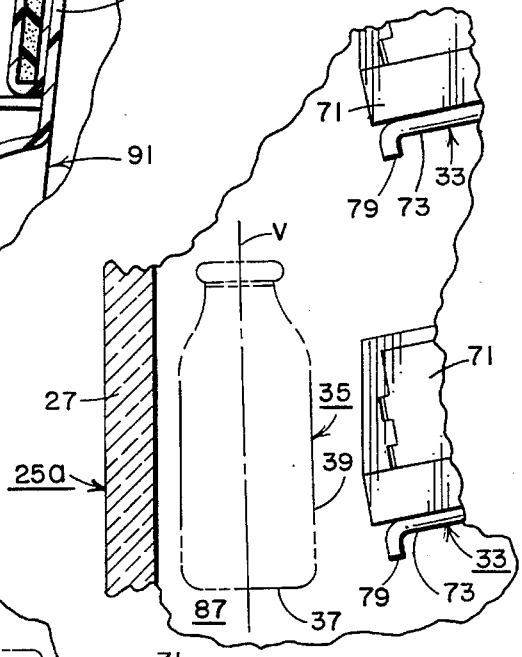
Figure 8:
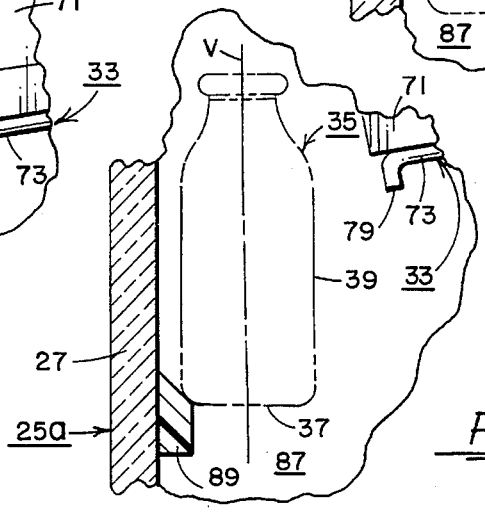
Figure 9:
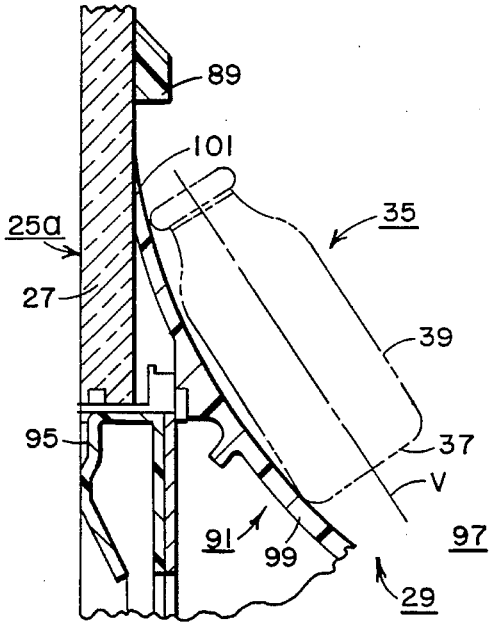
FIGS. 9–13, respectively, are enlarged fragmentary views taken from FIG. 4 showing the dispensing of the glass container from the vertical drop chute through the recovery unit and further illustrating principles of the aforementioned method.

As illustrated in FIG. 5, when glass container 35 is dispensed from channel 45 of tray 33, the disposed glass container slides from lip section 73 of the channel into vertical chute 87 of vending machine 21, and at least when the dispensed glass container passes beyond depending flange 79 on lip section 73, the vertical axis V of the dispensed glass container is tilted generally toward transparent pane 27 in front panel **25*a* of cabinet 23. When the dispensed glass container 35 passes from lip section 73 into vertical chute 87 with the vertical axis V of the dispensed glass container tilted, as discussed above, a part of the circumferential portion 39 of the dispensed glass container engages or abuts a part of transparent pane 27 in front panel 25*a* of cabinet 23, as seen in FIG. 6. In response to the engagement of the dispensed glass container 35 with transparent pane 27, as discussed above, the attitude of the dispensed glass container is adjusted or changed so that the vertical axis V of the dispensed glass container is predeterminately altered or realigned into a generally vertically extending position in vertical chute 87, as seen in FIG. 7. With the vertical axis V of the dispensed glass container 35 so realigned in its generally vertically extending position in vertical chute 87, as discussed above, the dispensed glass container drops base portion 37 first in a generally vertical free fall path through a part of vending machine 21 defined by the vertical chute. To terminate the dropping of the dispensed glass container 35 in its vertical free fall path through chute 87, base 37 of the dispensed glass container engages abutment 89 secured to transparent pane 27 adjacent the lower end of vertical chute 87, as seen in FIG. 8. In response to the engagement between base portion 37 of the dispensed glass container 35 and abutment 89, as discussed above, the dispensed glass container is deflected or otherwise directed from the vertical free fall path thereof in vertical chute 87, and subsequent to such deflection, the passage of the dispensed glass container is effected through another path in the vending machine angularly arranged with and different than the vertical free fall path, as seen in FIG. 9**.

Upon the above discussed deflection or diversion of the dispensed glass container 35 into its another path, the dispensed glass container is received base portion 37 first in slide section 99 of reentrant passage 97 within casing 91 of recovery unit 29, and upon the entry of the dispensed glass container into the slide section, the circumferential portion 39 of the dispensed glass container is engaged in sliding relation with the slide section. Thus, it may be noted that the altitude of the dispensed glass container is again altered or changed during the passage of the dispensed glass container through slide section 99 of reentrant passage 97 in casing 91 of recovery unit 29 so that the vertical axis V of the dispensed glass container is angularly disposed with respect to the vertically extending position of the vertical axis V during the above discussed vertical free fall path of the dispensed glass container through vertical chute 87.

Figure 10:
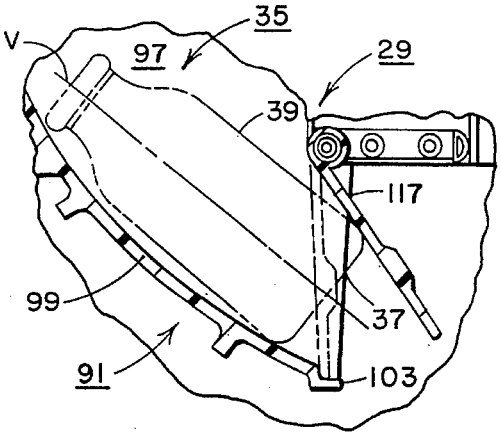

Upon the sliding passage of the dispensed glass container through slide section 99 of reentrant passage 97, as discussed above, base portion 37 of the dispensed glass container engages closure device 117 to momentarily pivotally displace it from its sealing position in the slide section, as seen in FIG. 10. Of course, displacement of closure device 117 from its sealing position in slide section 99 momentarily permits egress of the refrigerated air from cabinet 23 of vending machine 21 through reentrant passage 97 in casing 91 of recovery unit 29 toward access opening 31 thereof.

Figure 11:
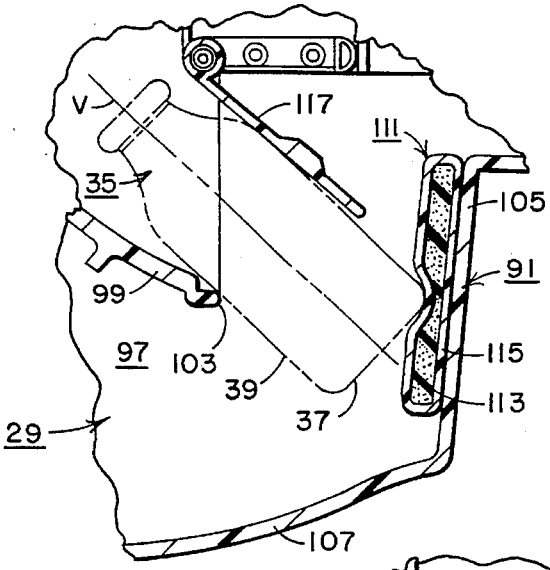
Figure 12:
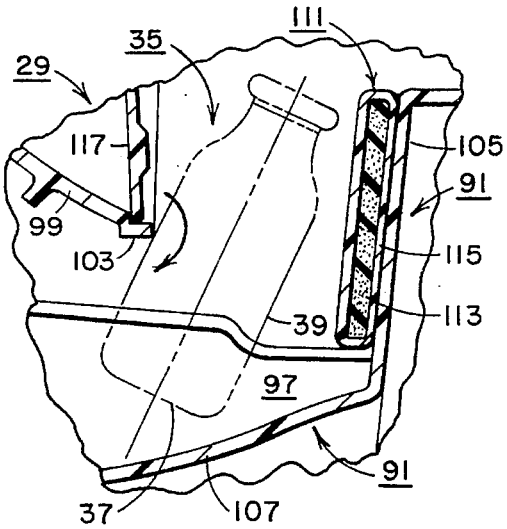

Subsequent to the above discussed pivotal displacement of closure member 117 from its sealing position in slide section 99, base portion 37 of the dispensed glass container 35 moves beyond free end 103 of slide section 99 in recovery unit casing 91 into engagement with cushioning device 111 mounted within reentrant passage 97 on rear wall 105 of recovery unit casing 91, and the strip of ergonomic urethane foam 113 in the cushioning device yields to resiliently absorb a part of the energy of the dispensed glass container established during its drop through the vertical free fall path in vertical chute 87, into reentrant passage 97 of recovery unit casing 91, as seen in FIG. 11. The resiliency of ergonomic urethane foam strip 113 is effective to rebound the dispensed glass container 35 from cushioning device 111 and thereby redirect the dispensed glass container base portion 37 first into receiving section 107 of recovery unit casing 91 toward access opening 31 in front face 95 thereof, as seen in FIG. 12. Upon the passage of the dispensed glass container 35 into recovery section 107 of recovery unit casing 91, base portion 37 of the dispensed glass container engages rim 109 provided in part about access opening 31 in front face 95 of the recovery unit casing, and the engagement of base portion 37 with rim 109 terminates the passage of the dispensed glass container in reentrant passage 97 in an arrested position at least generally adjacent access opening 31.

Figure 13:
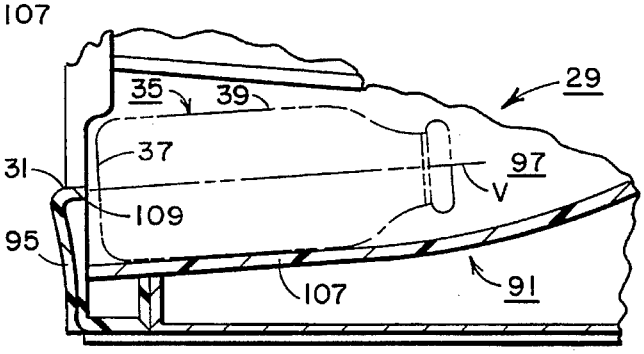

Of course, when dispensed glass container 35 passes into a position in reentrant passage 97 disengaged from closure device 117 therein, the closure device is pivotally returned into its sealing position, as shown in FIG. 4, in the reentrant passage thereby to again at least limit egress of refrigerated air through the reentrant passage toward access opening 31 in front face 95 of recovery unit casing 91, as seen in FIG. 10. To complete the description of the operation of vending machine 21, it may be noted that subsequent to the engagement of the dispensed glass container 35 with cushioning device 111, the dispensed glass container is rotated within reentrant passage 97 with a part of circumferential portion 39 of the dispensed glass container engaged with free end 103 of slide section 99 in recovery unit casing 91, as illustrated by the rotational arrow in FIG. 13, thereby to deliver the dispensed glass container base portion 37 first into receiving section 107 of the reentrant passage in the recovery unit casing toward access opening 31 thereof.

From the foregoing, it is now apparent that a novel vending machine 21 and a novel method of operating a vending machine have been presented, and it is contemplated that various changes in the precise details and connections of the component parts in such vending machine, as well as the precise order of the steps of such method, may be made by those having ordinary skill in the art without departing from the spirit of the invention or the scope of the invention as defined by the claims which follow.

What is claimed is:

1. A method of operating a vending machine in response to the selective generation of a preselected vending signal, the vending machine including at least one supporting means for slidably supporting a plurality of glass containers of a vended beverage arranged in row formation on the at least one supporting means, an open end portion on the at least one supporting means, and a generally vertical chute, and each glass container including a vertical axis and a base portion disposed about the vertical axis and slidably received on said at least one supporting means, the method comprising the steps of:

slidably displacing one of the glass containers on its base portion from the at least one supporting means through the open end portion thereof toward the vertical chute in response to the selective generation of the preselected vending signal;

tilting the vertical axis of the one container during the slidably displacing step and entering the one glass container with its vertical axis tilted into the vertical chute;

engaging a part of the one glass container with a part of the vertical chute during the entering step and realigning the vertical axis of the one glass container into a generally vertically extending position in the vertical chute in response to the engaging step; and dropping the one glass container base portion first through the vertical chute with the vertical axis of the one glass container disposed in its generally vertically extending position.

2. The method as set forth in claim 1 wherein the vending machine further includes a reentrant passage extending generally angularly from the vertical chute and an abutment in the vertical chute, and the method further comprising the additional steps of abutting the base portion of the one glass container with the abutment in the vertical chute during the dropping step and deflecting the one glass container base portion first from the vertical chute into the reentrant passage in response to the abutting step.

3. The method as set forth in claim 2 wherein the vending machine further includes a cushioning device in the reentrant passage, and wherein the method further comprises the further additional steps of directing at least a part of the base portion of the one glass container into engagement with the cushioning device and absorbing a part of the energy of the one glass container established during its drop through the vertical chute into the reentrant passage upon the engagement of the one glass container with the cushioning device.

4. The method as set forth in claim 3 wherein the vending machine further includes at least one access opening communicating with a part of the reentrant passage and wherein the method further comprises the further additional steps of rebounding the one glass container base portion first from the cushioning device into the reentrant passage part and terminating the passage of the one glass container through the reentrant passage within the reentrant passage part adjacent the at least one access opening.

5. The method as set forth in claim 4 wherein the rebounding step includes rotating the one glass container within the reentrant passage and delivering the one glass container base portion first into the reentrant passage part.

6. The method as set forth in claim 2 wherein the vending machine further includes a pivotally movable door disposed in a sealing position in the reentrant passage for at least restricting refrigerated air in the vending machine against displacement therefrom through the reentrant passage, and wherein the method further comprises the further additional steps of pivotally moving the door from its sealing position in the reentrant passage in response to the passage therethrough of the one glass container and pivotally returning the door into its sealing position subsequent to the pivotally moving step.

7. A method of operating a vending machine in response to the selective generation of a preselected vending signal to vend a selected one of beverages contained in a plurality of glass containers from the vending machine, the glass containers each having a vertical axis and a base portion disposed about the vertical axis, the method comprising the steps of:

dispensing one of the glass containers in the vending machine in response to the selective generation of the preselected vending signal;

tilting the vertical axis of the one glass container during the dispensing step and then predeterminately altering the vertical axis of the one glass container into a generally vertically extending position in the vending machine; and thereafter dropping the one glass container base portion first in a generally vertical free fall path through a part of the vending machine with the vertical axis of the glass container disposed in its vertically extending position.

8. The method as set forth in claim 7 further comprising the additional steps of deflecting the one glass container from the generally vertical free fall path thereof and effecting the passage of the one glass container from its generally vertical free fall path through another path in another part of the vending machine different than the generally vertical free fall path in response to the deflecting step.

9. The method as set forth in claim 8 wherein the effecting step includes changing the attitude of the one glass container during its passage through at least a part of the another path so that the vertical axis of the one glass container is angularly disposed with respect to the generally vertically extending position of the vertical axis of the one glass container in the generally vertical free fall path thereof.

10. The method as set forth in claim 8 wherein the vending machine includes an abutment disposed between the generally vertical free fall path and the another path and wherein the deflecting step includes abutting the base portion of the one glass container with the abutment.

11. The method as set forth in claim 10 wherein the effecting step includes diverting the one glass container generally base portion first into the another path in response to the abutting step.

12. The method as set forth in claim 8 wherein the another part of the vending machine includes a slide portion defining at least a part of the another path and wherein the effecting step includes receiving the glass container generally base portion first on the slide portion.

13. The method as set forth in claim 12 wherein each glass container further includes a circumferential portion arranged about the vertical axis and the base portion and wherein the receiving step includes engaging a part of the circumferential portion of the one glass container in sliding relation with the slide portion.

14. The method as set forth in claim 8 wherein the vending machine includes a cushioning device disposed in the another path and wherein the method further comprises the further additional step of engaging the base portion with the cushioning device and resiliently absorbing a part of the energy of the one glass container established during its drop through the generally vertical free fall path into the another path.

15. The method as set forth in claim 14 wherein the vending machine further includes at least one access opening associated with the another path and wherein the method further comprises the further additional step of rebounding the one glass container from the cushioning device and terminating the passage of the one glass container in the another path generally adjacent the at least one access opening.

16. The method as set forth in claim 15 wherein the rebounding step includes redirecting the one glass container generally base portion first from the cushioning device toward the at least one access opening.

17. The method as set forth in claim 16 wherein the redirecting step includes rotating the one glass container within the another path and delivering the one glass container base portion first toward the at least one access opening in response to the rebounding step.

18. The method as set forth in claim 8 wherein the vending machine includes a closure device pivotally disposed in a sealing position in the another path for at least restricting refrigerated air in the vending machine against displacement flow therefrom through the another path, and wherein the method further comprises the further additional step of pivotally displacing the closure device from its sealing position in the another path in response to the passage therethrough of the one glass container and pivotally returning the closure device into its sealing position in the another passage subsequent to the pivotally displacing step.

19. A vending machine for selectively vending beverages respectively contained in a plurality of glass containers upon the selective generation of a preselected vending signal, each glass container including a vertical axis and a base portion disposed about the vertical axis, the vending machine comprising:

a cabinet including a generally vertical chute, at least one access opening in said cabinet, and a reentrant passage generally angularly arranged with said chute and having a pair of sections communicating with said vertical chute and said at least one access opening, respectively;

at least one supporting means arranged in said cabinet for slidably supporting the base portions of the glass containers arranged generally in row formation on said at least one supporting means, said at least one supporting means including an open end portion communicating with said vertical chute, and means selectively operable in response to the selective generation of the preselected vending signal for controlling the slidable displacement of one of the glass containers from said at least one supporting means through said open end portion thereof into said vertical chute with the vertical axis of the one glass container being tilted at least upon the displacement of the one glass container into said vertical chute;

said cabinet further including means associated with said vertical chute for abutment with a part of the one glass container other than the base portion thereof to realign the vertical axis of the one glass container into a generally vertically extending position and effect a generally vertical free fall of the one glass container base portion first through said vertical chute, and another abutment means extending into said vertical chute for engagement with the base portion of the one glass container for directing the one glass container base portion first from said vertical chute into one of said sections of said reentrant passage; and a cushioning device disposed in said reentrant passage generally between said one section and the other of said sections thereof and engageable with at least a part of the base portion of the one glass container for absorbing at least some of the energy of the one glass container established during its vertical free fall through said vertical chute into said one section of said reentrant passage and for rebounding the one glass container base portion first from said one section into an arrested position in said other section of said reentrant passage adjacent said at least one access opening.

20. The vending machine as set forth in claim 19 wherein the one glass container further includes a circumferential portion disposed about the vertical axis and the base portion and wherein said one section of said reentrant passage includes slide means for slidably receiving a part of the circumferential portion with the end portion generally facing the cushioning device.

21. The vending machine as set forth in claim 20 wherein said slide means include a free end predeterminately spaced from said cushioning device, the one glass container being pivoted generally about said free end of said slide means in response to the engagement of the at least part of the base portion with said cushioning device to effect the rebounding from said cushioning device of the one glass container base portion first into said other section of said reentrant passage.

22. The vending machine as set forth in claim 19 wherein said cabinet means further includes means disposed about at least a part of said at least one access opening for engagement with the base portion of the one glass container to generally define the arrested position of the one glass container in said other section of said reentrant passage.

23. A vending machine for dispensing a selected beverage each contained in a glass container in response to the selective generation of a preselected vending signal, each glass container including a generally vertical axis and a base portion disposed about the vertical axis, the vending machine comprising:

a cabinet;

a generally vertical passage means arranged in said cabinet for receiving each glass container base portion first and with its vertical axis tilted when each glass container is dispensed in the vending machine upon the selective generation of the preselected vending signal, said vertical passage means including means engageable with another part of each glass container for realigning its vertical axis into a generally vertically extending position to ensure a generally vertical free fall passage of each glass container base first through said vertical passage means when each glass container is received therein;

another passage means associated in generally angular relation with said vertical passage means in said cabinet for the passage of each glass container base portion first from said vertical passage means into said another passage means; and a cushioning device associated with said another passage means and engageable with the base portion of each glass container for absorbing at least some of the energy of each glass container established during the vertical free fall passage of each glass container through said vertical passage means into said another passage means and for rebounding each glass container base portion first toward an arrested position in a part of said another passage means.

24. The vending machine as set forth in claim 23 further comprising abutment means associated with said vertical passage means and engageable with the base portion of each glass container upon the vertical free fall passage thereof through said vertical passage means for deflecting each glass container base portion first into said another passage means.

25. The vending machine as set forth in claim 23 wherein at least said vertical passage means and said another passage means are subjected to refrigerated air in the vending machine and wherein the vending machine further comprises closure means pivotally urged toward a passage closing position in said another passage means for at least limiting flow of refrigerated air therethrough, said closure means being momentarily pivotally displaced by each glass container upon the passage thereof base portion first through said another passage means.

26. The vending machine as set forth in claim 23 wherein said cushioning device includes yieldable means engageable with the base portion of each glass container upon the passage thereof through said another passage means for effecting the energy absorption and the rebounding of each glass container.

27. The vending machine as set forth in claim 26 wherein said yieldable means comprises an ergonomic foam.

28. The vending machine as set forth in claim 23 wherein each glass container includes a circumferential portion disposed about the vertical axis and connected with the base portion and wherein said another passage means includes slide means arranged in another part of said another passage means for slidably receiving a part of the circumferential surface of each glass container with the base portion thereof generally facing said cushioning device.

29. The vending machine as set forth in claim 28 wherein the slide means include a free end predeterminately spaced from said cushioning device, each glass container being pivoted generally about said free end of said slide means in response to the engagement of the base portion of each glass container with said cushioning device to effect the rebounding from said cushioning device of each glass container base portion first into said first named part of said another passage means.

30. The vending machine as set forth in claim 23 further comprising at least one access opening in said cabinet communicating with said another part of said another passage means and through which each glass container may be manually retrieved from the arrested position thereof in said first named part of said another passage means.

31. The vending machine as set forth in claim 30 further comprising means associated with said cabinet and extending at least in part about said at least one access opening into said first named part for engagement with the base portion of each glass container upon the rebounding thereof from the cushioning device into said first named part of said another passage means.

32. The vending machine as set forth in claim 23 further comprising at least one supporting means arranged in said cabinet adjacent said vertical passage means for slidably supporting a plurality of the glass containers on the base portions thereof and generally disposed in row formation on said at least one supporting means, and means associated with said at least one supporting means and operable generally in response to the generation of the preselected vending signal for selectively dispensing each glass container from said at least one supporting means into said vertical passage means.

* * * * *